US005830161A

United States Patent [19]

Cosmano

[11] Patent Number: 5,830,161

[45] Date of Patent: Nov. 3, 1998

[54] ALTERNATING RIBBED FOOT MASSAGER

[76] Inventor: Robert J. Cosmano, 3370 Par Dr., La Mesa, Calif. 91941

[21] Appl. No.: 733,949

[22] Filed: Oct. 21, 1996

Related U.S. Application Data

[63] Continuation-in-part of Ser. No. 601,533, Feb. 14, 1996, abandoned.

[51] Int. Cl.[6] ..... A61H 15/00

[52] U.S. Cl. ..... 601/121; 601/118

[58] Field of Search ..... 601/118, 119, 601/120, 121, 115, 117, 122, 123, 124, 125, 126, 127

[56] References Cited

U.S. PATENT DOCUMENTS

| | | | |
|---|---|---|---|
| 2,080,208 | 5/1937 | Illch | 601/121 |
| 2,168,842 | 8/1939 | Kesteven et al. | 601/118 |
| 2,307,554 | 1/1943 | Wettlaufer | 601/72 |
| 2,546,095 | 3/1951 | Gustlin | 601/121 |
| 2,582,686 | 1/1952 | Fabio | 601/118 |
| 3,037,500 | 6/1962 | Daugherty | 601/121 |
| 3,067,738 | 12/1962 | Karlik | 601/120 |
| 3,419,268 | 12/1968 | Bellet | 601/121 |
| 3,845,758 | 11/1974 | Anderson . | |
| 4,378,007 | 3/1983 | Kachadourian | 601/121 |
| 5,131,383 | 7/1992 | Juarez . | |
| 5,143,056 | 9/1992 | Yih-Jong | 601/118 |

FOREIGN PATENT DOCUMENTS

| | | | |
|---|---|---|---|
| 56549 B | 6/1944 | Netherlands | 601/121 |
| 389241 | 3/1933 | United Kingdom | 601/119 |

*Primary Examiner*—Michael A. Brown
*Assistant Examiner*—Benjamin K. Koo
*Attorney, Agent, or Firm*—Frank G. Morkunas

[57] ABSTRACT

A foot massager is built around a cylinder that preferably mounts two axially spaced longitudinally ribbed, bulging sleeves separated by a radially extended central partition disk and captured at their outer ends by roller disks, each having end stops to prevent the massager from rolling too far. The sleeve has alternating short and substantially compressible tall ribs to clutch the skin of a user's foot and thereby enhance the soothing effect. The cylinder mounts a vibrator internally. The user places his feet respectively on the two bulged sleeves, turns on the vibrator, and rolls his feet forward and backward in a reciprocating motion that rolls the vibrator on the floor beneath his feet. The configuration of the ribbed sleeves is such that the user can roll his feet against curved end ramps defined on both the inside (the side closer to the other foot) and outside of each foot for a complete massage of all foot surfaces.

12 Claims, 2 Drawing Sheets

ALTERNATING RIBBED FOOT MASSAGER

CROSS REFERENCE AND RELATED APPLICATIONS

This application is a continuation-in-part of my co-pending U.S. Patent application, Ser. No. 08/601,533, filed on Feb. 14, 1996, now abandoned.

BACKGROUND OF THE INVENTION

Numerous types of massaging-devices have been developed over the years. Many have been marketed. The more successful massagers are those which are relatively portable and provide relief and comfort to the user at tired, sore, or otherwise weary parts of the body. The purpose of these massagers is to comfort. The more typical massagers are related to the neck, the spine, and the shoulders. Some are merely general-purpose vibrators rather than pure massagers. Few of these devices are specifically tailored and designed for the feet and its attendant surfaces. Those tailored for the feet only provide comfort and relief for the soles without adequately accommodating the sides of the feet.

There are many different types of massagers. One type is a roller-type exerciser with a hard bumpy surface. Most of the massagers roll in place with no translational motion, and at least one has been found that does roll. Roller-type exercisers are used to build skeletal muscles, often requiring that the user grasp the roller with the hands and roll out in an arched position to put tremendous strain on the abdominal muscles. Similarly the feet may be involved, but these are in a different class than the instant device and do not massage, but strengthen. The instant invention does not involve itself in strengthening. Its purpose is strictly to soothe all of the sore and tired foot surfaces, not just the soles, by use of vibration (to massage) and heat.

Such roller-type products or concepts that are used for the feet have certain characteristics that are believed by the instant inventor to be in need of improvement. First, most, if not all such devices have a bumpy exterior surface, usually hard bumps that push into the flesh. Sore feet do not always respond well to these hard bumps. The skin itself does not really benefit optimally since the bumps are intended to work on the flesh beyond the skin. Yet the skin itself may well be the sorest of all. The contours of the roller may not permit the sides of the feet, both inner and outer, to be massaged, but overly concentrate on the soles. Lastly, none of the known roller-type foot exercisers or massagers actually vibrate, although vibration is of course a common technique to enhance massaging action. Nor do these prior art devices include the unique, massage-enhancing, alternating tall substantially flexible ribs and short substantially rigid ribs through the entire massage surface of the device in combination with heating elements to further enhance the soothing comfort experienced by the user.

SUMMARY OF THE INVENTION

The instant invention addresses these perceived shortfalls and supplies a remedy. The massager is an elongated roller, preferably long enough to fit both feet on at one time. Instead of the hard surfaces and bumps of prior art massagers, the instant invention has a series of alternating tall (distal) and short (proximal) substantially evenly spaced ribs running longitudinally across the entire massaging surface (sleeve) of the device. The tall ribs are substantially flexible and soft; the short ribs are substantially more rigid than the tall ribs.

The massaging surface (sleeves) is constructed of these alternately spaced ribs. This configuration facilitates the soothing process. The tall ribs, being more flexible and spaced apart from each succeeding tall rib by a distance substantially twice the distance between the distance of a tall rib to a proximal rib, permit greater lateral affinity to a user's foot and thereby result in greater compressibility, clutchability of the foot, and soothing power. This has a salutary effect on the feet and, because of the surface clutchability, tends to restore tired feet surfaces while massagers with hard bumps cannot.

The sleeves address of the existence of soreness in the sides of the feet as well as the bottoms. The sleeves have steep bulging ramps on each side of the massager. These ramps are unique features which permit the user to massager the inner and the outer side of each foot. A user has the flexibility to custom-select the areas of his feet that need massaging the most and to position them accordingly.

In using this device, the user rolls his feet up against the left or right ramp, or keeps them in the middle alternatively, as is appropriate to his discomfort. While the user is doing this, powerful vibrators within the massager radiate oscillatory motion to soothe the nerves and amplify the action of the tall ribs, which have clutched and 'held' the skin of the user's foot in stimulating, soothing, and massaging the surfaces of the feet.

In addition to the vibration, heat pads located below the surface of the sleeve, on its ramps and on the surface of the sleeve between the ramps, further enhance the soothing effect being experienced. As the user rolls the massager with his strategically placed feet thereon, the user can be assured that the device will not 'run' away from him. Roller disks on the ends of the massager, which are substantially round, have end stops with substantially acute angles, opposed to one another which halt the roll of the massager. A side view of a roller disk with an end stop resembles a tear drop. The user can use this massager, get a warm soothing skin clutching vibrating massage, without threat of rolling away, all subconsciously while relaxing, watching television, working on the computer, reading, and the like, as it requires no significant effort. This device is especially beneficial to women who are pregnant, whose feet are often chronically tired and sore. On anyone, this massager restores feet to a stimulated, fresh condition, after experiencing a condition of throbbing, soreness, and tenderness such that the user felt he would never walk again.

DETAILED DESCRIPTION OF THE PREFERRED EMBODIMENT

Figures 1, 2:
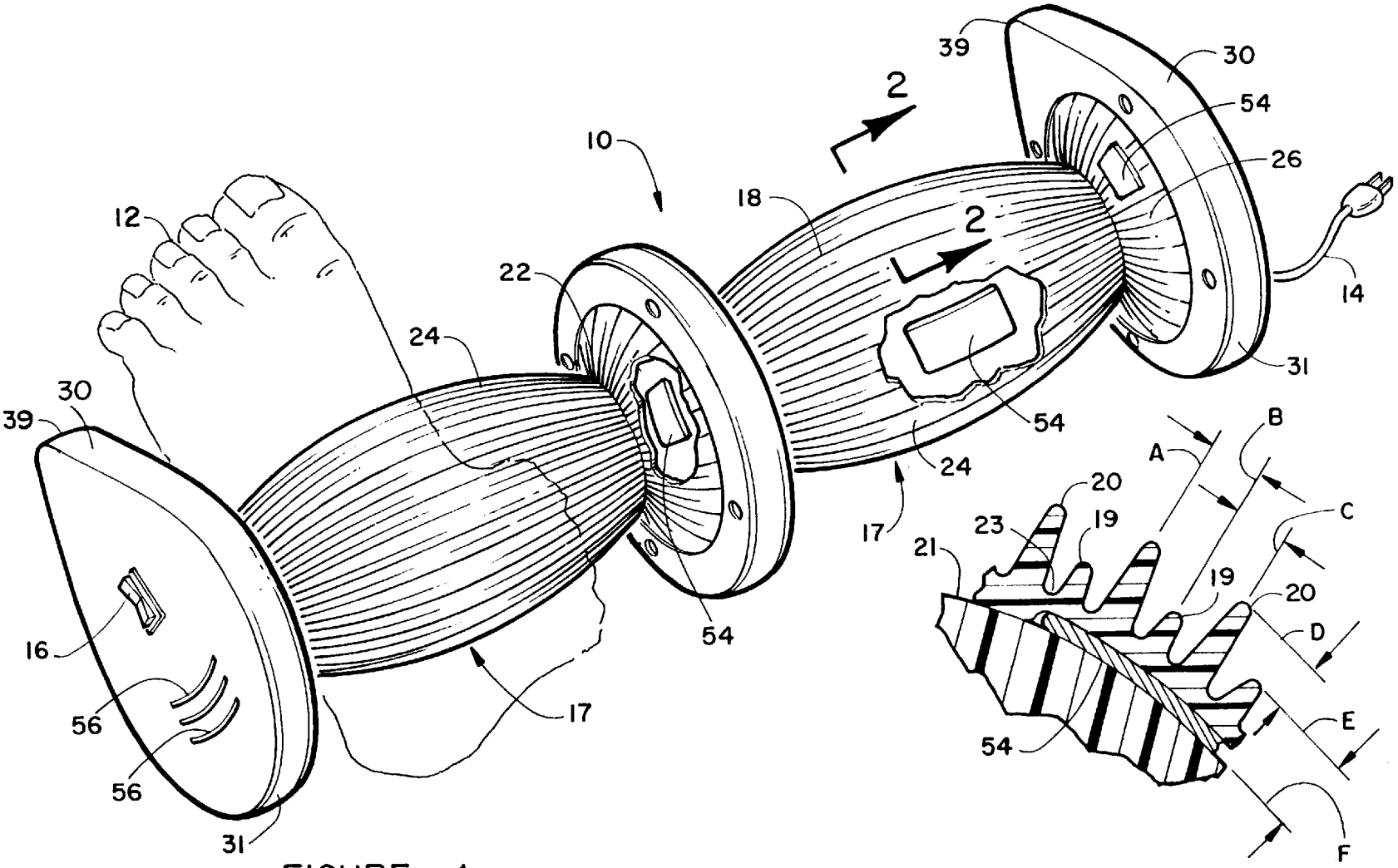
FIG. 1 is a perspective view of the massager.
FIG. 2 is a transverse partial sectional view through the ribbed sleeve taken on line 2—2 of FIG. 1.

The massager 10 is shown in use in FIG. 1, wherein the left foot 12 of the user is rolling the massager back and forth on the floor, the right foot not being shown. The massager 10 is limited in its back and forth motion by end stops 39 on each roller disk 30 which act to interrupt such continued motion in the same direction. End stops 39 can be of any configuration such as tandem Δ pairs of acute angles, extensions, nubs, cam lobes or any other device suited for the intended purpose, on roller disk 30. The preferred embodiment has acute angles which make roller disk 30 substantially resemble a tear drop.

Roller disks 30 also may have protective or cushion-like end cover 31 around its outside surface circumference and end stops 39. End cover 31 may be of any plastic, plastic-like, rubber, rubber-like, cushion-like material, or any other material suited for the intended purpose. The internal vibrator may be battery activated or powered from cord 14, controlled with switch 16. The massager is divided into two distinct left and right sides for the respective feet.

The bulged sleeves 18 are an important aspect of the invention. These sleeves are made from a longitudinally ribbed covering. Ribs 17 run longitudinally across the entire width of massager 10 excluding central disk 32 and roller disks 30. The ribs have alternating long ribs 20 and short ribs 19 (see FIG. 2). In between each rib is rib valley 23. These ribs make up sleeve 18. Sleeve 18 is adjacent to massager inner surface 21. Rib valleys 23 may be as deep as massager inner surface 21 or as nearly thereto as is possible or may extend upward toward, but not as high as short ribs 19.

Tall ribs 20 are deeply relieved and substantially soft, flexible, and resilient (providing for compressibility, rubbery-like), similar to the material which achieved notoriety a decade ago as the good-feeling fatigue-fighting handgrips used on motorcycles. They were both very comfortable and easy to rotate to control acceleration. They bulged centrally, and were substantially unsupported centrally such that they would compress to fit the hand of the user to a certain extent. These are exactly the same characteristics that the material of the sleeves 18 has.

Tall ribs 20 range in distance from tip (point D of FIG. 2) to massager inner surface 21 (point F of FIG. 2) approximately 5/16" to 9/16". Ideal length is 7/16".

Short ribs 19 are not as resilient as tall ribs 20 generally because of their substantial stubbiness. Not being as long as tall ribs 20, short ribs 19 are less flexible and less resilient to contact. As a result, they are substantially more rigid than tall ribs 20. Both however can be made of the same material. In addition, for rigidity, short ribs 19 may be coated or detailed to be more rigid, or they may be made of different material than tall ribs 20 to establish greater rigidity.

Any polymer may be used for sleeve 18 including, but not limited to, polyethylene, polypropylene, or polyurethane, or any other such polymer suited for the intended purpose. Where short ribs 19 and tall ribs 20 of sleeve 18 are made of different materials, short ribs 19 may be made of a more brittle polymer such as, but not limited to, acrylics or polycarbonates, or any other material suited for the intended purpose.

Short ribs 19 range in distance from tip (point E of FIG. 2) to massager inner surface 21 (point F of FIG. 2) approximately 3/16" to 5/16". Ideal length is 1/4". Lateral spacing between one tall rib to another, as shown in FIG. 2 by points A to C, is approximately 3/8" to 1/2"; ideal distance is approximately 7/16". Lateral spacing between one short rib 19 to one tall rib 20, as shown by points A to B and points B to C, is approximately 3/16" to 1/4". Spacing of ribs and length of ribs in relation to one another is important to this invention.

In addition to short and tall ribs 19, 20 as shown in FIG. 2, sleeve 18 has restricted portions 22 separated by an outwardly bulging portion (central sleeve) 24, with the sleeve end portions (or ramps) 26 expanding radially outwardly again. Heat elements 54 also can be included in central sleeve 24 and sleeve ends (or ramps) 26. Such heat elements 54 can be under sleeve 18, adjacent to and in between massager inner surface 21 or on the surface of sleeve 18 at central sleeve 24 and ramps 26. Where heat elements 54 are placed on the surface of sleeve 18, ribs 17 are cut-out in the shape of heat elements 54 and heat element 54 is inserted in the cut-out. Such a cut-out would involve the removal of one or more tall and short ribs. FIG. 1 at ramp 26 reveals a surface mounted heat element 54. Heat element 54 in this configuration is covered with a suitable covering (not shown) suited for the intended purpose.

Also in such configuration, the upper surface of heat element 54 extends substantially higher than the tip of remaining short ribs 19 (or substantially up to point E of FIG. 2). In the preferred embodiment of this invention, heat elements 54 are on the surface of sleeve 18 resting is the cut-outs described above. All heat elements 54 are strategically placed on sleeve 18 for maximum comfort and relief to a user. Heat elements 54 are connected to switch 16 using a suitable switch which provides vibration only, heat only, or both, as the case may be. As is easily visualized from FIG. 1, the user can roll the bottoms or the sides of his feet against the sleeves depending on where he positions them. He can roll either foot up against either of the ramped ends 26 of the respective sleeve to massage all the way up to the ankle. In all such places, the user will experience the clutching vibrating comfort of the alternating substantially soft (tall ribs 20) and substantially rigid (short ribs 19) and the heat associated with a optimum soothing effect.

Figure 3:
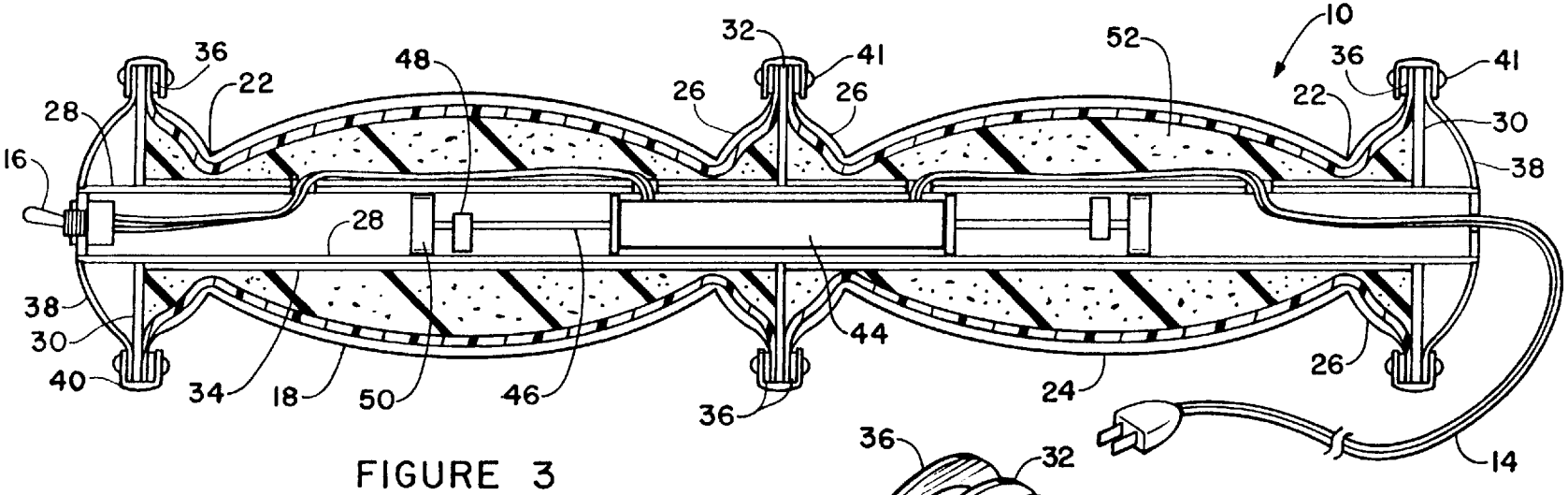
FIG. 3 is a longitudinal cross-section view through the invention.
Figure 5:
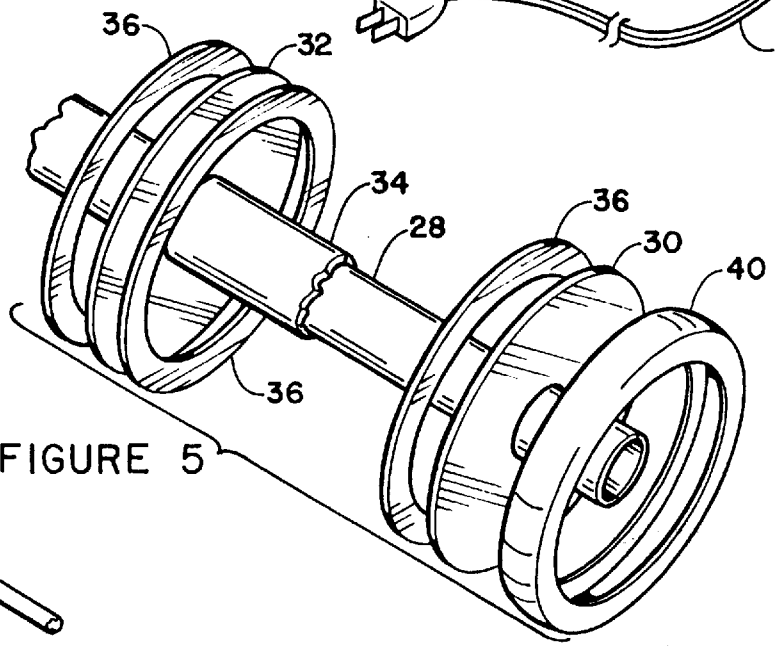
FIG. 5 is an exploded perspective of the disks and other rigid parts used in the invention.
Figure 4:
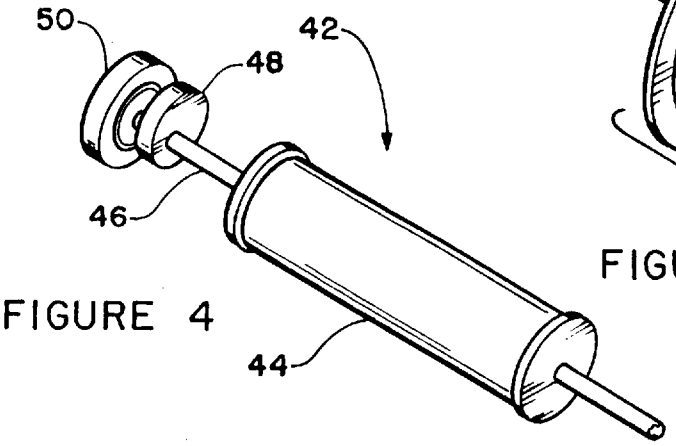
FIG. 4 is a partial detail of the vibrator motor in perspective.

The interior of the invention, from which the construction can be understood, can be seen in FIG. 3. The body of the massager has a core cylinder 28. Mounted on this cylinder are two roller disks 30 at the respective ends of the tube, and a central partition disk 32. The partition disk actually is identical to the roller disks in the actual unit, and all of them roll on the floor, but theoretically only the outer two disks would have to be rollers, and the central disk could be of decreased diameter. The outer disks (roller disks 30) have end stops 39 to limit the roll of massager. These disks (roller disks 30 and central disk 32) are maintained in place by spacer cylinders 34 and whatever other stabilizing structure is needed. Each of these disks serves to mount the circumferential end portions of the sleeves, which is done by capturing the peripheral edges of the sleeves with rings 36 and screwing or bolting the rings to the disks to sandwich the material of the sleeves therebetween. Rings 36 are similar to washers having a large diameter opening and a substantially wide circumference as seen in FIG. 5.

The ends of the massager body may be terminated with end caps 38, also screwed or bolted to the respective roller disk. The inner end portions are attached to the partition disk 32, which is identical to the roller disks 30 except that since roller disks 30 hold the roller load, conceivably the central disk could be of reduced diameter. Lastly, the edges of the disks are preferably terminated by a snap-on, resilient rim cap 40 to finish off the massager and hold in place, as well as hide, the screws 41. The rim 40 covers all the screws, those which secure both the rings 36 and the end caps 38. They also provide a frictional contact with the floor so that the unit can be used on linoleum and hardwood floors without slipping.

Internally of the core cylinder 28 resides a vibrator 42. In this application, the central motor 44 has a drive shaft 46 that extends out in both axial directions from the motor, and drive rotating eccentric masses 48. The tall ends of the shaft are stabilized with bearings 50, with the masses being axially central to the respective sleeve 18 to maximize vibration transmission. Power to the vibrator can be by batteries lodged in the cylinder, an alternative that is not shown here, or by means of the aforementioned AC power cord 14. Power is delivered through the switch 16, which could be multi-level, i.e. having at least two speeds. This same power source supplies power to heat elements 54. This same switch also provides heat control capabilities to increase the heat emanating from heat elements 54 or to decrease the heat. Air vents 56 on roller disk end caps 38 prevent excess build up of heat generated by motor 44 but not heat generated by heat elements 54.

Foam mass 52 engulfs spacer 34 and runs the full length of spacer 34 between two roller disks 30. Foam mass 52 created the central bulge in sleeve 18 and aids in creating the ramped ends 26 as restricted portions 22, adjacent to roller disks 30 and central disk 32, begin an outward configuration. Foam mass 52 terminates at rings 36, at roller disks 30, and central disk 32. When vibrator 42 within cylinder 28 is activated, foam mass 52 vibrates and transmits the vibration to sleeve 18 throughout its central bulge and ramped ends 26. The cord passage, as shown, must pass both of the rotating masses 48, and is routed through the cylinder, then outside through the foam mass 52 to avoid the rotating vibrator structure.

After using the massager, it becomes obvious the advantages that the ribbed exterior, the vibration, and the ramped sides provide. A pair of very sore feet will ordinarily become a pair of good feeling feet after a few minutes. Although there are obviously a variety of ways to construct the massager, as long as they include these key features, as set forth in the accompanying claims, they would attain the goals of the described apparatus.

It is hereby claimed:

1. A roller foot massager device comprising:

(a) an elongated body defining a longitudinal axis and having;

(i) at least two axially spaced roller disks coaxial with said body, said roller disks each having a circumference;

(ii) at least one sleeve having a bulging central portion and ramped end portions ramping substantially up to the circumference of said roller disks, said sleeve being of substantially circular transverse cross section, having outward projecting alternating short and tall longitudinal ribs wherein said tall longitudinal ribs are substantially compressible and said short ribs are substantially hard, each of which are adapted to massage the skin of a user's feet in an alternate manner, said alternating short and tall longitudinal ribs spanning between and being coaxial with said disks; and (iii) a foam mass within said at least one sleeve and between said axially spaced roller disks; such that a user can place his foot on said at least one sleeve and push it forward and rearwardly to roll it over a horizontal surface in a reciprocating motion, to massage the surfaces and sides of the foot as said tall longitudinal ribs converge and diverge, and permit massaging access to said short ribs, with the compression and release of said tall longitudinal ribs on said at least one sleeve during said motion.

2. The device as set forth in claim 1 wherein said elongated body is sized and configured to have a predetermined axial length whereby a user can rest both feet longitudinally spaced thereon, and said at least one sleeve is a pair of sleeves, together spanning substantially the entire distance between said roller disks.

3. The device as set forth in claim 1 further having at least one heat means located between said sleeve and said foam mass.

4. The device as set forth in claim 1 wherein said roller disks have stopping means thereon to interrupt the roll of said massager.

5. The device as set forth in claim 2 wherein said elongated body includes a central partition disk parallel to, coaxial with, and of diameter no greater than, said roller disks, and positioned substantially axially centrally of said body and separating said pair of sleeves, to define two separated portions of said body for the left and right foot, respectively.

6. The device as set forth in claim 5 wherein said elongated body defines an axially extended cylindrical tube as its core and said disks are mounted on said core.

7. The device as set forth in claim 6 wherein said sleeves are substantially continuous lengths of material with said ribs being substantially continuous throughout their lengths, said sleeves each being bunched radially inwardly to define an outwardly bulged, arcuate central portion and bulging end portions to permit the user to roll a foot on the central portion to massage the sole of the foot, or roll it left or right to massage a respective side of the foot on the respective end portion.

8. The device as set forth in claim 2 wherein said body has an electrically powered vibrator therein to vibrate said sleeves in use.

9. The device as set forth in claim 8 wherein said body defines an axially extended cylindrical tube as its core and said vibrator is mounted in said tube.

10. The device as set forth in claim 9 wherein said vibrator has a motor with a shaft extending completely through and out of said motor in both axial directions and including an eccentric mass mounted on said shaft on each axial side of said motor.

11. The device as set forth in claim 10 wherein each of said masses is substantially axially centrally mounted on said shaft relative to a respective one of said sleeves.

12. The device as set forth in claim 4 wherein said stopping means comprises a tandem pair of cam-lobes on said at least two axially spaced roller disks.

* * * * *